US008431850B2

(12) United States Patent
Huang et al.

(10) Patent No.: US 8,431,850 B2
(45) Date of Patent: Apr. 30, 2013

(54) BUTTON STRUCTURE

(75) Inventors: Ri-Dong Huang, Shenzhen (CN); Chang-Zheng Xu, Shenzhen (CN); Hsuan-Tsung Chen, Taipei Hsien (TW); Guang-Yao Lee, Taipei Hsien (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 386 days.

(21) Appl. No.: 12/916,609

(22) Filed: Oct. 31, 2010

(65) Prior Publication Data

US 2012/0043190 A1 Feb. 23, 2012

(30) Foreign Application Priority Data

Aug. 23, 2010 (CN) ..... 2010 1 0259953

(51) Int. Cl.
*H01H 13/14* (2006.01)

(52) U.S. Cl.
USPC ..... 200/341; 200/314; 200/520; 200/293

(58) Field of Classification Search ..... 200/341–345, 200/302.2, 302.3, 293–296, 520, 314
See application file for complete search history.

(56) References Cited

U.S. PATENT DOCUMENTS

| | | | | |
|---|---|---|---|---|
| 7,253,370 | B2 * | 8/2007 | Chen et al. | 200/341 |
| 7,601,925 | B1 * | 10/2009 | Li et al. | 200/293 |
| 7,635,820 | B2 * | 12/2009 | Shen et al. | 200/314 |
| 8,247,719 | B2 * | 8/2012 | Lee et al. | 200/296 |

* cited by examiner

*Primary Examiner* — Tulsidas C Patel
*Assistant Examiner* — Marina Fishman
(74) *Attorney, Agent, or Firm* — Altis Law Group, Inc.

(57) ABSTRACT

A button structure includes an installation assembly, a slidable member, a pressable member, and a first resilient member and a second resilient member. The slidable member is slidably attached to the installation assembly. A pressable portion is formed on the slidable member. The pressable member is pivotably mounted to the installation assembly. A pressable cantilever extends from the pressable member. A guide portion protrudes from the pressable cantilever and abuts against the pressable portion. When the slidable member is pushed to deform the first resilient member, the pressable portion presses the guide portion to urge the pressable member to pivot. Thus the second resilient member is deformed, and the pressable cantilever pushes the button to power on or off the electronic device. When the slidable member is released, the first and second resilient members are restored to respectively force the slidable member and the pressable member to return.

13 Claims, 5 Drawing Sheets

BUTTON STRUCTURE

BACKGROUND

1. Technical Field

The present disclosure relates to button structures, and more particularly, to a button structure used in a computer enclosure for powering on or off an electronic device in the computer enclosure.

2. Description of Related Art

In a computer system, a computer bezel is provided to decorate its computer enclosure. Power buttons typically utilized to selectively enable or inhibit the flow of electrical current to electronic devices, such as compact disc read-only memory (CD-ROM) drives, are usually covered by doors placed on the computer bezel. Consequently, it would be desirable to provide a button structure for conveniently pressing the power buttons covered by the doors.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
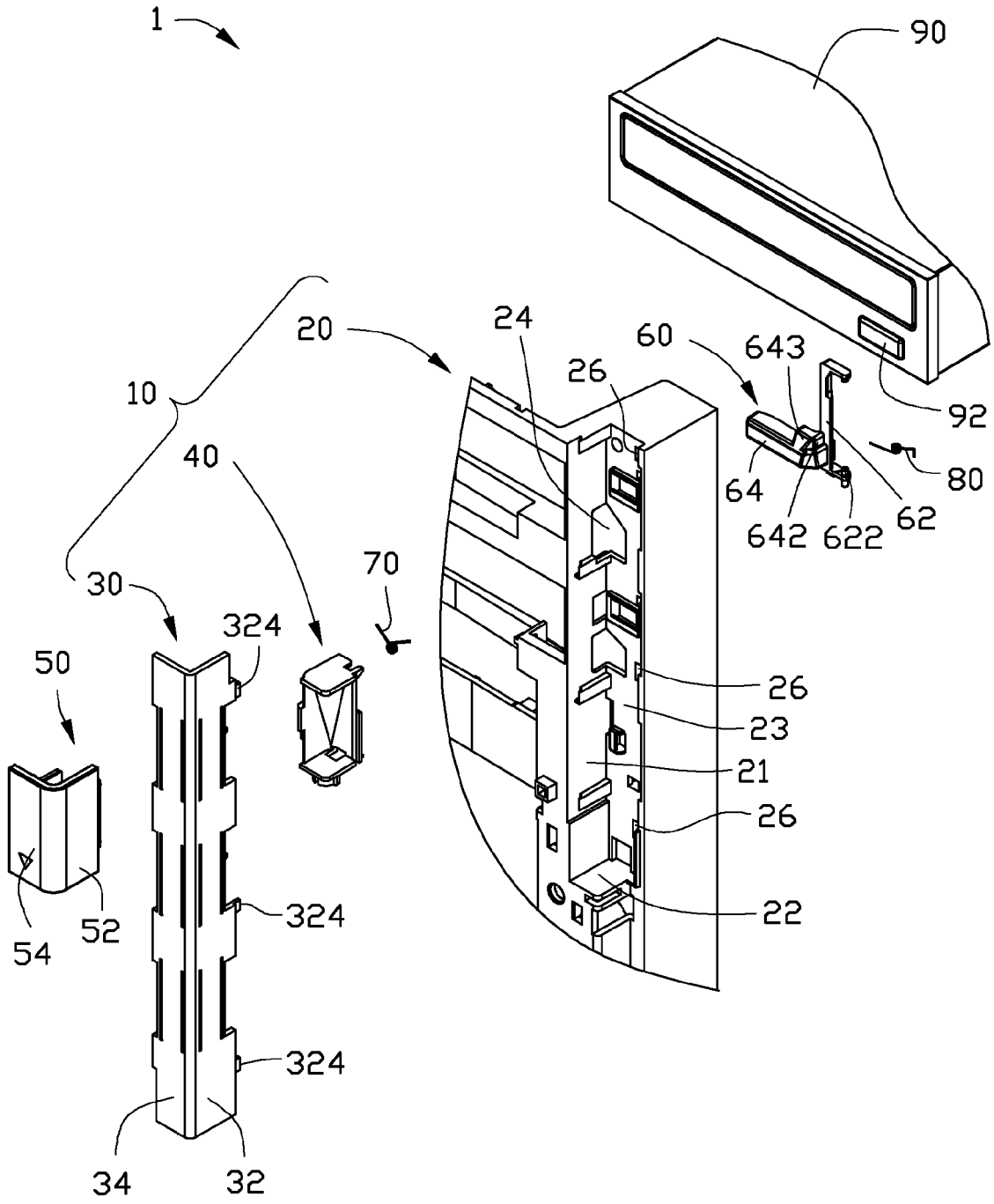
FIG. 1 is a cutaway, exploded, isometric view of an exemplary embodiment of a button structure, together with a compact disc read-only memory (CD-ROM) drive.
Figure 2:
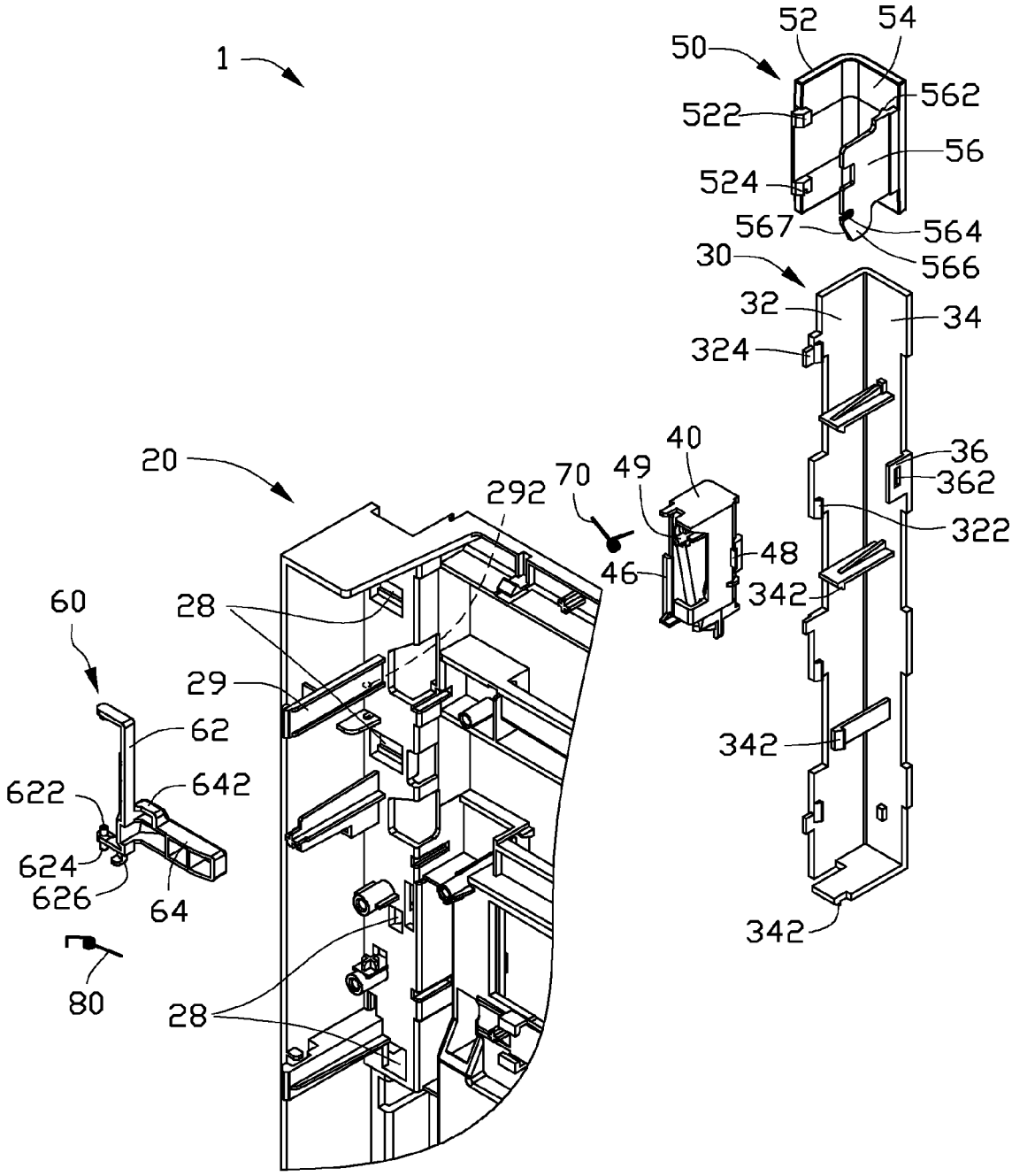
FIG. 2 is similar to FIG. 1, but viewed from another perspective and with the CD-ROM drive omitted.
Figure 3:
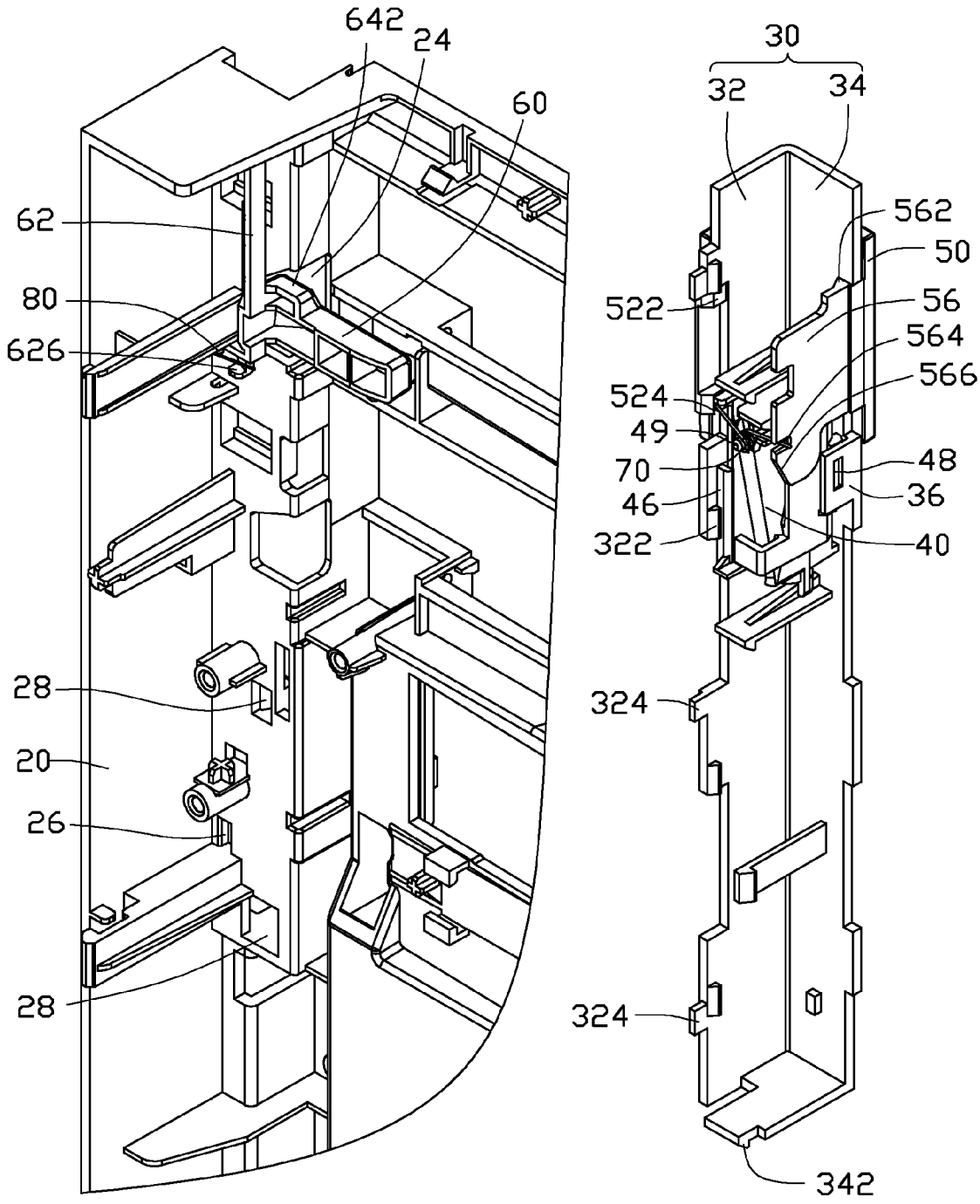
FIG. 3 is a partial, assembled, isometric view of the button structure of FIG. 2.

Referring to FIGS. 1 and 2, a button structure 1 in accordance with an exemplary embodiment is used to press a button 92 of an electronic device 90 for powering on or off the electronic device 90. The button structure 1 includes an installation assembly 10, a slidable member 50, a pressable member 60, and a first resilient member 70 and a second resilient member 80 respectively for forcing the slidable member 50 and the pressable member 60 to return. In the embodiment, the electronic device 90 is a compact disc read-only memory (CD-ROM) drive. The first and second resilient members 70 and 80 are two torsion springs 70 and 80.

Figure 4:
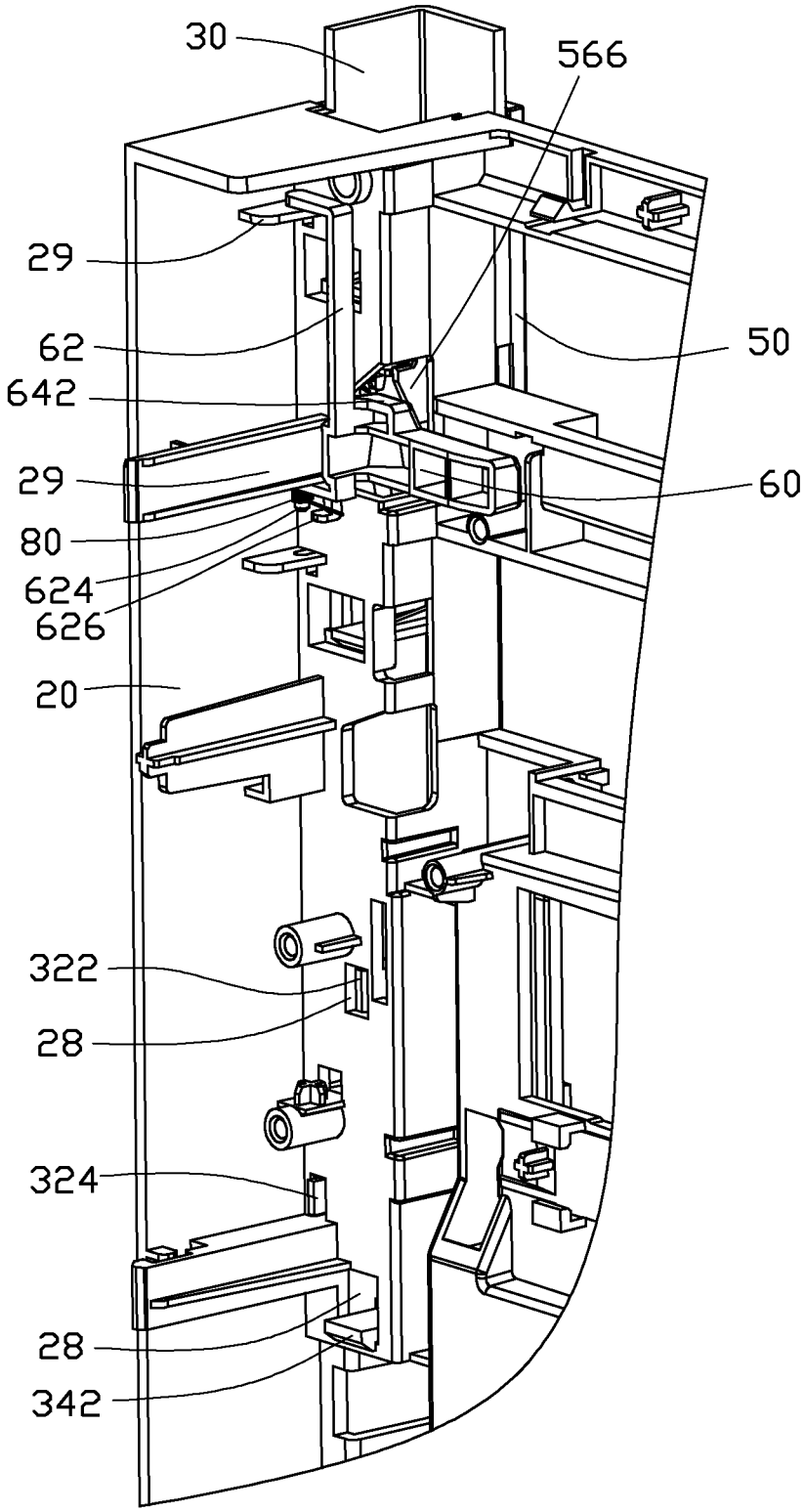
FIG. 4 is an assembled, isometric view of the button structure of FIG. 2.

The installation assembly 10 includes a main body 20, an elongated rack 30, and an engageable member 40. In the embodiment, the main body 20 is a computer bezel 20, and only a portion of the computer bezel 20 is shown in the drawings. A side of the main body 20 is depressed to form an elongated hold space 22. The hold space 22 includes a first sidewall 21 and a second sidewall 23 perpendicularly connected to the first sidewall 21. A plurality of location holes 26 and a plurality of hook holes 28 are defined in the second sidewall 23. A through hole 24 is defined in a conjunction of the first sidewall 21 and the second sidewall 23. Two mount portions 29 (see FIG. 4 together) each defining a pivot hole 292 protrude from a rear surface of the second sidewall 23.

The rack 30 may be received in the hold space 22 of the main body 20. The rack 30 includes a first wall 32 and a second wall 34 substantially perpendicularly extending from one side of the first wall 32. A wedge-shaped projection 322 protrudes from the other side of the first wall 32 opposite to the second wall 34, and the projection 322 opposes the second wall 34. A plurality of location tabs 324 extend from the other side of the first wall 32, corresponding to the location holes 26 of the main body 20. A plurality of L-shaped hooks 342 project from an inner surface of the second wall 34, corresponding to the hook holes 28 of the main body 20. A lockable portion 36 extends from one side of the second wall 34 opposite to the first wall 32. A lock hole 362 is defined in the lockable portion 36.

The engageable member 40 is hollow. An abutting flange 46 and a catch 48 are formed on the engageable member 40, corresponding to the projection 322 and the lock hole 362 of the lockable portion 36. A post 49 extends from the engageable member 40.

The slidable member 50 includes a first slidable plate 52 slidably engaging with the first wall 32 of the rack 30, and a second slidable plate 54 perpendicularly connected to one side of the first slidable plate 52 and slidably engaging with the second wall 34 of the rack 30. Two first limitation blocks 522 are formed at the other side of the first slidable plate 52 opposite to the second slidable plate 54, and slidably retained at the other side of the first wall 32. A first latch hole 524 is defined in one of the first limitation blocks 522, corresponding to a first end of the torsion spring 70. A board 56 perpendicularly extends from one side of the second slidable plate 54 opposite to the first slidable plate 52. Two second limitation blocks 562 opposing the first slidable plate 52, are formed on an inner surface of the board 56 and slidably retained at the side of the second wall 34 opposite to the first wall 32. A second latch hole 564 is defined in the board 56, corresponding to a second end of the torsion spring 70. A pressable portion 566 with a slanted surface 567 is formed on the board 56.

The pressable member 60 includes a U-shaped pivot frame 62 and a pressable cantilever 64 perpendicularly extending from the pivot frame 62. Two pivot shafts 622 respectively protrude from opposite ends of the pivot frame 62 towards each other, corresponding to the pivot holes 292 of the mount portions 29 of the main body 20. A spindle 624 and a bent portion 626 project from one of the ends of the pivot frame 62. A guide portion 642 with a slanted surface 643 protrudes from the pressable cantilever 64 adjacent to the pivot frame 62.

Referring to FIGS. 1-4, in assembly, the engageable member 40 is placed between the first wall 32 and the lockable portion 36 of the rack 30. Then it is pressed towards the second wall 34 of the rack 30, thereby the abutting flange 46 of the engageable member 40 is snappingly engaged with the projection 322 of the first wall 32 and the catch 48 of the engageable member 40 is engaged in the lock hole 362 of the lockable portion 36. The first and second slidable plates 52 and 54 of the slidable member 50 slidably engage respectively with the first and second walls 32 and 34 of the rack 30, opposite to the engageable member 40. The first limitation blocks 522 of the first slidable plate 52 are retained at the other side of the first wall 32, and the second limitation blocks 562 of the board 56 are retained at the side of the second wall 34 opposite to the first wall 32. Thus, the slidable member 50 is slidably mounted to the rack 30. The torsion spring 70 fits about the post 49 of the engageable member 40, with the first and second ends of the torsion spring 70 respectively latched in the first and second latch holes 524 and 564 of the slidable member 50. The torsion spring 70 resiliently presses the slidable member 50. The combined rack 30, engageable member 40, and slidable member 50 are received in the hold space 22 of the main body 20. The location tabs 324 of the rack 30 are engaged in the corresponding location holes 26 of the second sidewall 23, and the hooks 342 of the rack 30 are engaged in the corresponding hook holes 28. The installation assembly 10 is assembled. The pressable portion 566 of the slidable member 50 is in alignment with the through hole 24 in the hold space 22.

The pressable member 60 is pivotably attached behind the main body 20 of the installation assembly 10, opposite to the rack 30, with the pivot shafts 622 of the pivot frame 62 pivotably engaged in the pivot holes 292 of the corresponding mount portions 29 of the main body 20. The torsion spring 80 fits about the spindle 624 of the pivot frame 62, with opposite ends of the torsion spring 80 respectively abutting against the bent portion 626 of the pivot frame 62 and the main body 20. The torsion spring 80 urges the pressable member 60 to pivot allowing the pressable cantilever 64 of the pressable member 60 to abut against the main body 20. The guide portion 642 of the pressable cantilever 64 is extended through the through hole 24 of the main body 20 to abut against the pressable portion 566 of the slidable member 50, thereby the wedged mating relationship is formed between the slanted surface 567 of the pressable portion 566 and the slanted surface 643 of the guide portion 642.

Figure 5:
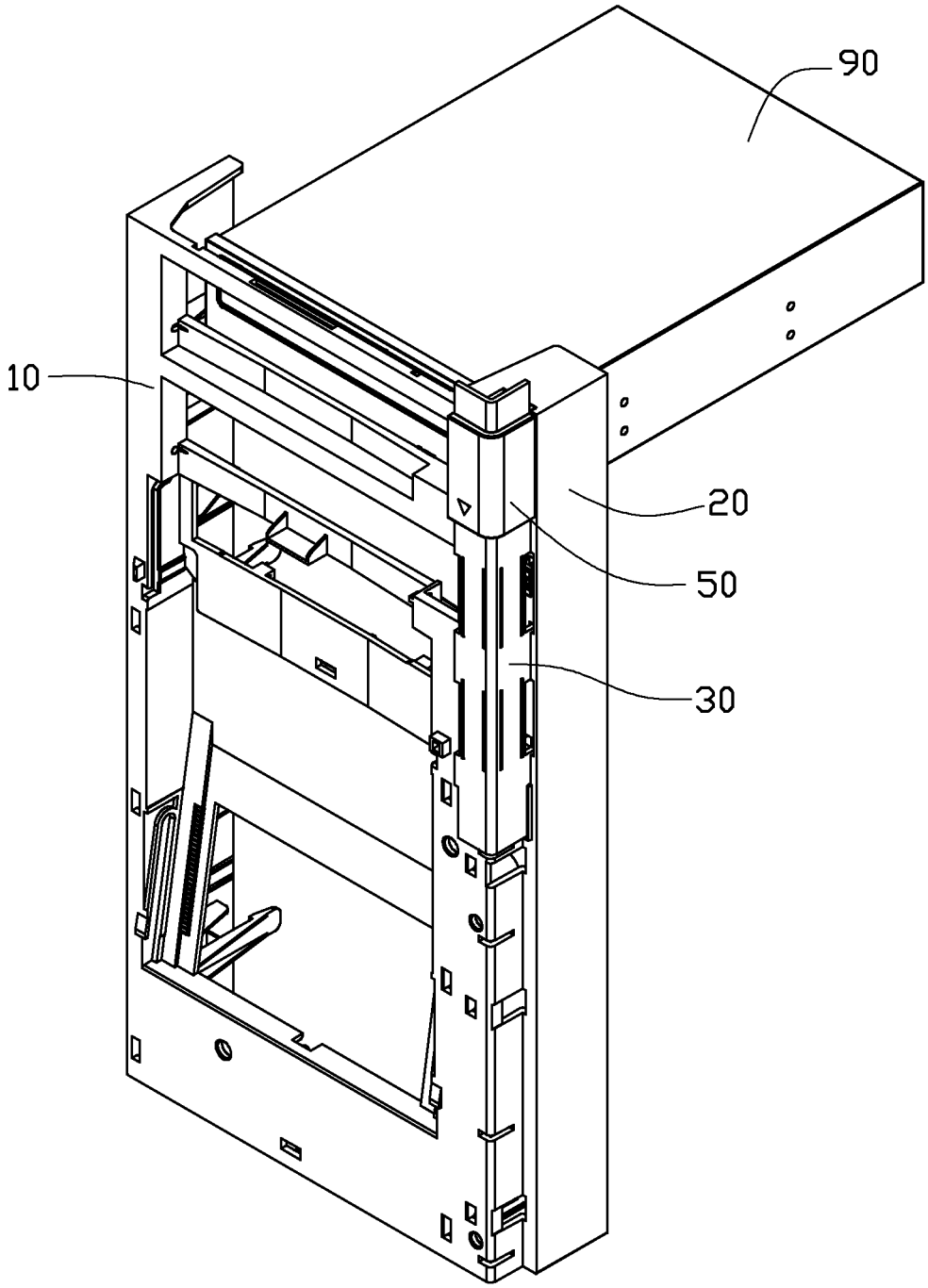
FIG. 5 is an assembled, isometric view of the button structure and the CD-ROM drive of FIG. 1.

Referring to FIG. 5, the electronic device 90 is secured to a back of the button structure 1, with the button 92 of the electronic device 90 in alignment with a distal end of the pressable cantilever 64 of the pressable member 60. The slidable member 50 is pushed along the rack 30 to deform the torsion spring 70, with the pressable portion 566 of the slidable member 50 pressing the guide portion 642 of the pressable member 60. In addition, the slanted surface 567 of the pressable portion 566 slides on the slanted surface 643 of the guide portion 642, thereby the pressable member 60 pivots allowing the pressable cantilever 64 to move away from the main body 20. The torsion spring 80 is deformed, and the distal end of the pressable cantilever 64 abuts against the button 92 of the electronic device 90 to trigger the button 92, therefore, the electronic device 90 is conveniently powered on or off.

When the slidable member 50 is released, the slidable member 50 slides along the rack 30 to return by the rebound of the torsion spring 70. The pressable member 60 pivots back with the pressable cantilever 64 resisting against the main body 20 by the rebound of the torsion spring 80. The guide portion 642 of the pressable cantilever 64 abuts against the pressable portion 566 of the slidable member 50.

In other embodiments, two arcuate surfaces may be respectively formed on the pressable portion 566 and the guide portion 642, or a slanted surface or an arcuate surface may be formed one of the pressable portion 566 and the guide portion 642. The rack 30 and the engageable member 40 may be integrally formed on the main body 20, and thus the installation assembly 10 has an integral structure. The first latch hole 524 of the slidable member 50 may be defined in the first slidable plate 52, and the second limitation blocks 562 of the slidable member 50 may be formed on the second slidable plate 54.

It is to be understood, however, that even though numerous characteristics and advantages have been set forth in the foregoing description of embodiments, together with details of the structures and functions of the embodiments, the present disclosure is illustrative only and changes may be made in detail, especially in matters of shape, size, and arrangement of parts within the principles of the present disclosure to the full extent indicated by the broad general meaning of the terms in which the appended claims are expressed.

What is claimed is:

1. A button structure for pressing a button of an electronic device, comprising:

an installation assembly;

a slidable member slidably attached to the installation assembly, a pressable portion formed on the slidable member;

a pressable member pivotably mounted to the installation assembly opposite to the slidable member, a pressable cantilever extending from the pressable member configured for pressing the button, and a guide portion protruding from the pressable cantilever and abutting against the pressable portion of the slidable member;

a first resilient member forcing the slidable member to return; and a second resilient member forcing the pressable member to return to make the pressable cantilever to move away from the button;

wherein when the slidable member is pushed to deform the first resilient member, the pressable portion presses the guide portion of the pressable cantilever to urge the pressable member to pivot, thereby the second resilient member is deformed and the pressable cantilever pushes the button to power on or off the electronic device; when the slidable member is released, the first and second resilient members are restored to force the slidable member to return, and to force the pressable member to return to make the pressable cantilever to move away from the button.

2. The button structure of claim 1, wherein the installation assembly comprises a main body; the main body is depressed to form a hold space, a through hole is defined in a sidewall bounding the hold space, and the guide portion of the pressable cantilever is extended through the through hole to abut against the pressable portion of the slidable member.

3. The button structure of claim 2, wherein two mount portions each defining a pivot hole protrude from a rear surface of the main body, the pressable member comprises a pivot frame, and two pivot shafts respectively protruding from opposite ends of the pivot frame; and the pivot shafts are pivotably engaged in the pivot holes of the mount portions.

4. The button structure of claim 3, wherein the installation assembly further comprises a rack covering the hold space of the main body.

5. The button structure of claim 4, wherein the rack comprises a first wall and a second wall connected to the first wall; and the slidable member comprises a first slidable plate slidably engaging with the first wall, and a second slidable plate connected to the first slidable plate and slidably engaging with the second wall.

6. The button structure of claim 5, wherein a plurality of first limitation blocks is formed on the first slidable plate of the slidable member and slidably retained to the first wall of the rack, and a plurality of second limitation blocks is formed on the second slidable plate and slidably retained to the second wall of the rack.

7. The button structure of claim 5, wherein a board extends from the second slidable plate of the slidable member opposite to the first slidable plate, and the pressable portion of the slidable member is formed on the board.

8. The button structure of claim 7, wherein a projection protrudes from the first wall of the rack, a lockable portion extends from the second wall of the rack opposite to the projection, a lock hole is defined in the lockable portion, the installation assembly further comprises an engageable member; an abutting flange and a catch are formed on the engageable member, and the engageable member is held among the first and second walls and the lockable portion of the rack, with the abutting flange abutting against the projection of the first wall and the catch engaged in the lock hole of the lockable portion.

9. The button structure of claim 8, wherein a post extends from the engageable member, a first latch hole and a second latch hole are respectively defined in the first slidable plate and the board of the slidable member, the first resilient member is a torsion spring fitting about the post, with opposite ends of the torsion spring respectively latched in the first and second latch holes.

10. The button structure of claim 5, wherein the hold space comprises a first sidewall opposite to the first wall of the rack, and a second sidewall substantially perpendicularly connected to the first sidewall and opposite to a second wall of the rack; a plurality of hook holes is defined in the second sidewall, a plurality of hooks projects from the second wall and hooked in the corresponding hook holes.

11. The button structure of claim 10, wherein a plurality of location holes is defined in the second sidewall, and a plurality of location tabs extends from the first wall and is engaged in the corresponding location holes.

12. The button structure of claim 5, wherein a spindle and a bent portion project from the pivot frame of the pressable member, and the second resilient member is a torsion spring fitting about the spindle, with opposite ends of the torsion spring respectively abutting against the bent portion and the main body.

13. The button structure of claim 2, wherein the main body is a computer bezel.

* * * * *